US010018451B1

(12) United States Patent
Ma

(10) Patent No.: US 10,018,451 B1
(45) Date of Patent: Jul. 10, 2018

(54) TOY DART

(71) Applicant: Alex Brands Buzz Bee Toys (HK) Limited, Kowloon (HK)

(72) Inventor: Chor-Ming Ma, Kowloon (HK)

(73) Assignee: Alex Brands Buzz Bee Toys (HK) Limited, Kowloon (HK)

( * ) Notice: Subject to any disclaimer, the term of this patent is extended or adjusted under 35 U.S.C. 154(b) by 0 days.

(21) Appl. No.: 15/402,767

(22) Filed: Jan. 10, 2017

(51) Int. Cl.
*F42B 6/00* (2006.01)
*F42B 12/74* (2006.01)

(52) U.S. Cl.
CPC ..... *F42B 6/003* (2013.01); *F42B 12/745* (2013.01)

(58) Field of Classification Search
CPC ..... F42B 6/003; F42B 6/08; F42B 12/362; F42B 12/745; A63H 33/18; B29C 45/00
USPC ..... 473/569, 572, 578, 581, 582
See application file for complete search history.

(56) References Cited

U.S. PATENT DOCUMENTS 3,801,102 A * 4/1974 Lohr ..... F42B 6/003 29/450
5,137,282 A * 8/1992 Segar ..... F42B 6/08 473/583
5,928,049 A * 7/1999 Hudson ..... A63H 27/004 446/15
6,083,127 A * 7/2000 O'Shea ..... A63H 33/18 446/213
6,099,379 A * 8/2000 Eppley ..... A63H 3/38 446/389
6,159,117 A * 12/2000 Chan ..... F42B 6/003 446/34
7,651,652 B1 * 1/2010 Cameron ..... B29C 33/0055 264/227
7,861,657 B2 * 1/2011 Danon ..... F42B 12/34 102/502
8,852,038 B1 * 10/2014 Hyde ..... F42B 6/04 473/578
8,968,126 B2 * 3/2015 Chia ..... F42B 6/08 473/578
9,261,336 B2 * 2/2016 Chang ..... F42B 6/003
9,435,621 B1 * 9/2016 Yeh ..... F42B 6/08
9,829,290 B2 * 11/2017 Chang ..... F42B 6/003
2004/0069177 A1 * 4/2004 Klein ..... F42B 12/36 102/502
2006/0046877 A1 * 3/2006 Gajda, Jr. ..... F42B 6/10 473/572
2006/0276277 A1 * 12/2006 Montefusco ..... F42B 8/16 473/586
2009/0050010 A1 * 2/2009 Tsang ..... F42B 6/003 102/502
2010/0216579 A1 * 8/2010 Williams ..... A63B 65/00 473/613
2015/0018144 A1 * 1/2015 Chia ..... F42B 12/34 473/582
2015/0045156 A1 * 2/2015 Lammonds ..... A01M 31/008 473/577

* cited by examiner

*Primary Examiner* — Alexander Niconovich

(57) ABSTRACT

The invention relates to a dart head for a toy dart. The dart head comprises a body having an enlarged head portion integrally formed with a stem portion longitudinally extended from the head portion, wherein the head portion is hollow. The invention also relates to a toy dart comprising a dart body connectable with the dart head as described.

5 Claims, 16 Drawing Sheets

TOY DART

FIELD OF THE INVENTION

The invention relates to a toy projectile and, particularly, but not exclusively, to a foam dart for use in a toy such as a toy gun.

BACKGROUND OF THE INVENTION

A large variety of toy launchers for projectiles such as bullets, darts, arrows or the like are available in the market. Among the various designs, a foam dart, which typically comprises a shaft or a body made of foam material connecting with a rigid head portion, has been gaining increasing popularity among both children and adult players due to their light weight and relatively low risk of injury especially when compared with the traditional darts which are very often formed of hard, solid plastic materials. Particularly, toy foam darts have been designed with functional features in order to improve aerodynamic flight properties, safety, as well as to enhance user's experience during a play.

OBJECTS OF THE INVENTION

An object of the present invention is to provide a novel foam dart for use with a toy.

Another object of the present invention is to provide a toy dart with a reduced or cushioned force of impact on a target to thereby enhance safety.

A further object of the present invention is to mitigate or obviate to some degree one or more problems associated with known toy projectiles, or at least to provide a useful alternative.

The above objects are met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides a dart head for a toy dart. The dart head comprises a body having an enlarged head portion integrally formed with a stem portion longitudinally extending from the head portion, wherein the head portion is hollow.

In a second main aspect, the invention provides a toy dart comprising a dart body connectable with the dart head in accordance with the first main aspect.

In a third main aspect, the invention provides a method of manufacturing the dart head according to the first main aspect. The method comprises the steps of providing a male mold and a female mold having at least a first female mold part and a second female mold part; injecting a flowable polymer between the male mold and the female mold; solidifying the polymer between the male mold and the female mold to form a solidified, molded polymer; separating the first female mold part from the molded polymer; and mechanically releasing the molded polymer from the second female mold part and the male mold.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figure, of which.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1A:
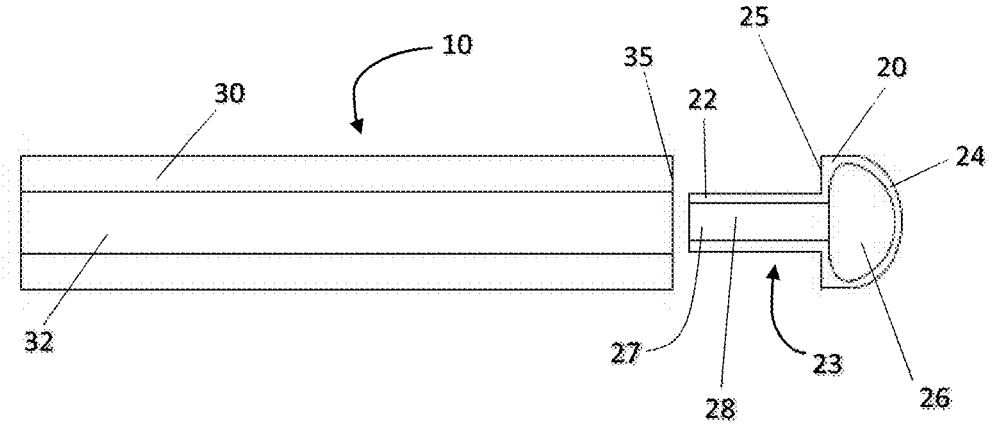
FIG. 1A shows a dart head and a dart body for a toy dart according to an embodiment of the present invention prior to connection.
Figure 1B:
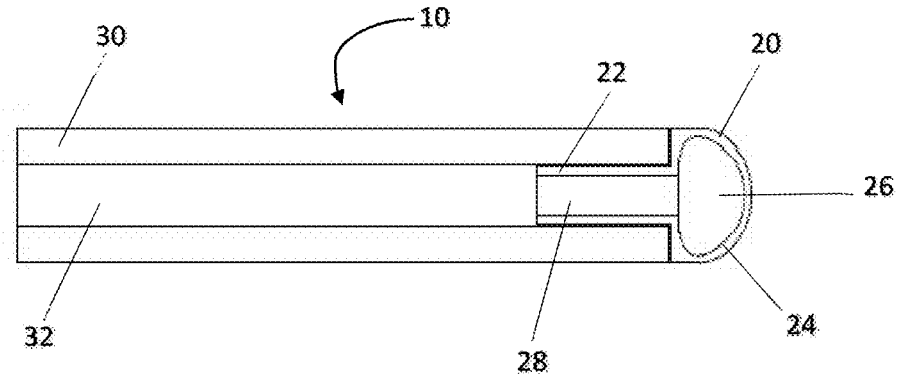
FIG. 1B shows the dart head and the dart body of FIG. 1A after connection to form a toy dart.
Figure 2A:
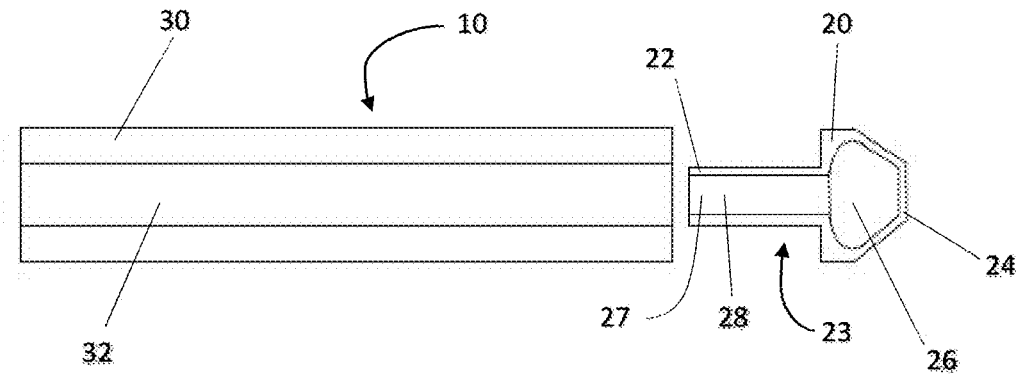
FIG. 2A shows a dart head and a dart body for a toy dart according to a second embodiment of the present invention prior to connection.
Figure 2B:
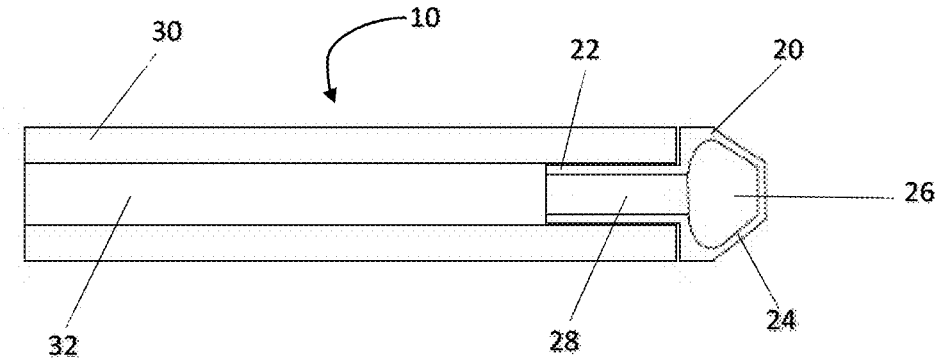
FIG. 2B shows the dart head and the dart body of FIG. 2A after connection to form a toy dart.
Figure 3A:
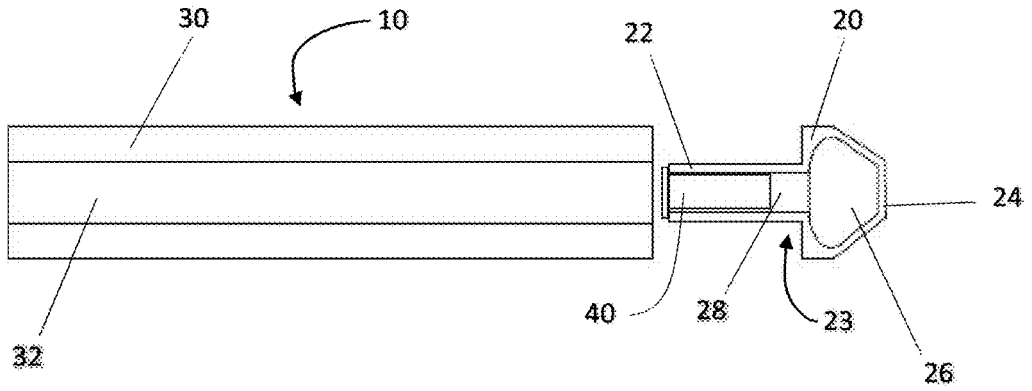
FIG. 3A shows a dart head, an insert and a dart body for a toy dart according to a third embodiment of the present invention prior to connection.
Figure 3B:
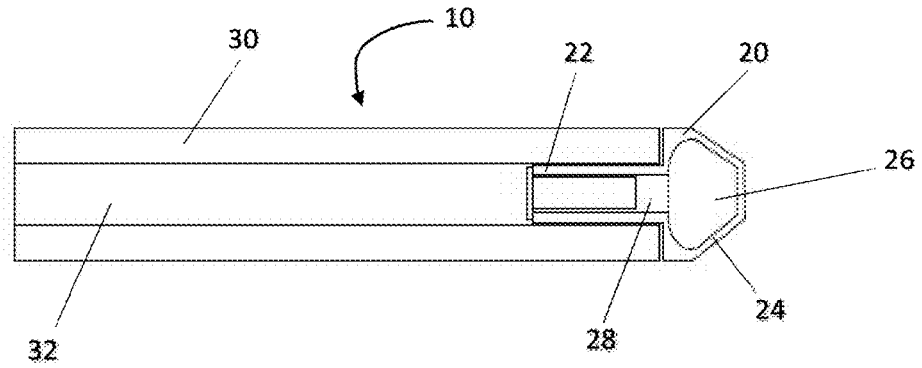
FIG. 3B shows the dart head, the insert and the dart body of FIG. 3A after connection to form a toy dart.
Figure 4A:
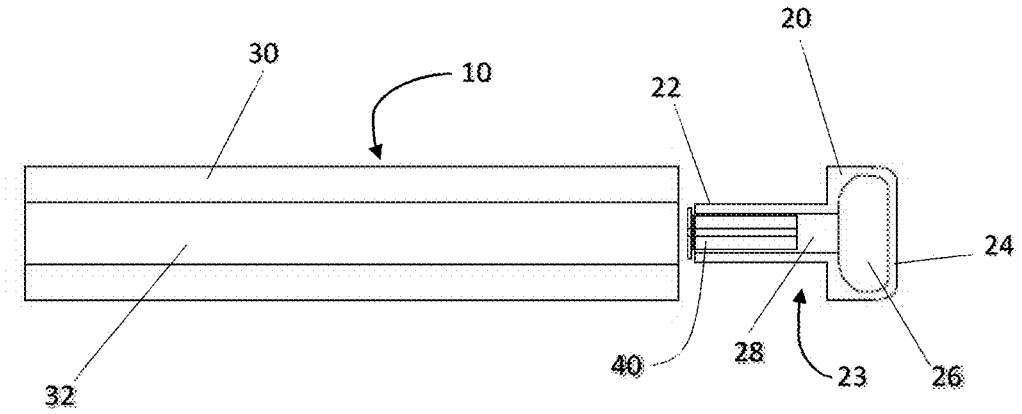
FIG. 4A shows a dart head, an insert and a dart body for a toy dart according to a fourth embodiment of the present invention prior to connection.
Figure 4B:
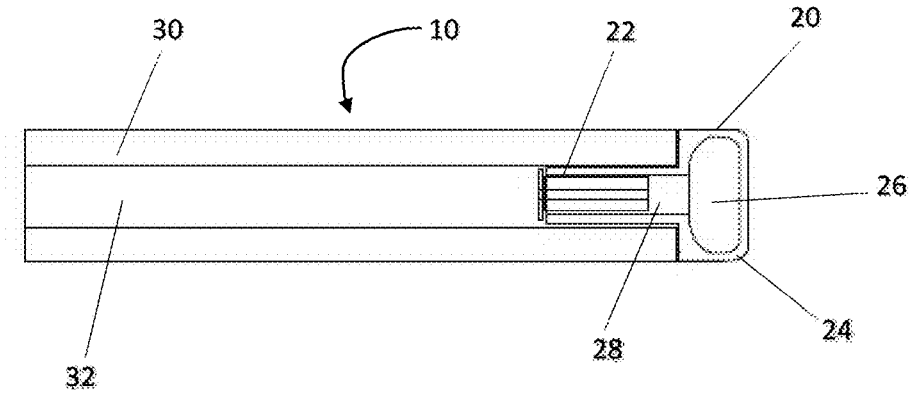
FIG. 4B shows the dart head, the insert and the dart body of FIG. 4A after connection to form a toy dart.

Referring to FIGS. 1A and 1B, shown is an embodiment of the toy dart 10 according to the present invention. The toy dart 10 may comprise a dart body 30 connectable with a dart head 20. In one embodiment, the dart head 20 is receivably connectable with the dart body 30 via an at least partially hollow, bore portion 32 of the dart body 30. Preferably, the dart body 30 is formed of at least one foam material such as, but not limited to, polyurethane, polyethylene, polystyrene or melamine foams, etc.

In this embodiment, the bore portion 32 of the dart body 30 extends the length of the dart body 30, although it needs not do so. The bore portion 32 of the dart body 30 is adapted to receive at least partially a stem portion 22 of the dart head 20 to thereby connect the dart body 30 with the dart head 20. Specifically, the dart head 20 comprises a body 23 having an enlarged head portion 24 integrally formed with the stem portion 22. The stem portion 22 is configured to longitudinally extend from the head portion 24. The head portion 24 is hollow to define at least one head cavity 26. In the context of this description, the expression "integrally formed" relates to a continuous material formation of the dart head body 23 having the head portion 24 and the stem portion 22 in a single piece, without the need of joining, adhering or any other form of connecting the head portion 24 and the stem portion 22 together after the respective head and stem portions are formed together.

In one embodiment, the stem portion 22 is also at least partially hollow to define at least one stem cavity 28, such that the at least one head cavity 26 of the hollow head portion 24 and the at least one stem cavity 28 of the hollow stem portion 22 can be arranged to be in a continuous, fluid communication. The dart head 20 is open at a rear end opening 27 of the stem portion 22 to form an undercut.

As shown in FIGS. 1A and 1B, the head portion 24 can be configured substantially in a hemispherical shape, with a flat, head base portion 25 adapted to abut a leading edge 35 of the dart body 30. The stem portion 22 is adapted to be snugly received by the bore portion 32 of the dart body 30 when the dart head 20 is arranged to connect with the dart body 30. FIGS. 2A and 2B, 3A and 3B, 4A and 4B, and 5A and 5B further show a number of embodiments of the dart head 20 in alternative configurations such as, but not limited to, in a shape of a conical frustum (see FIGS. 2A and 2B; 3A and 3B, and 5A and 5B), or cylindrical shape (see FIGS. 4A and 4B). The shape of the dart head is found to contribute to the flight performance of the resulting foam dart. For example, a dart with a cylindrically-shaped dart head is capable of achieving higher stability and thus better accuracy during shooting. While a dart with a conical frustum-shaped dart head may be able to fly further in air and thus a longer shooting distance due to the reduced forward-facing surface for air friction, but it is found to be less stable than the dart with a cylindrical dart head. This may be attributed to the relatively larger side pushing force or air dragging effect by the tapered wall of the conical frustum-shaped dart head during the flight.

The dart head 20 may optionally comprise an insert 40 adapted to be received in the hollow stem portion 22 of the dart head body 23. Specifically, the insert 40 is configured to be received and to extend at least partially along a length of the hollow stem portion 22. For example, FIGS. 3A and 3B, and 4A and 4B show the arrangement of the hollow stem portions 22 being partially filled by the respective inserts 40 starting from their rear end openings 27.

Figure 5A:
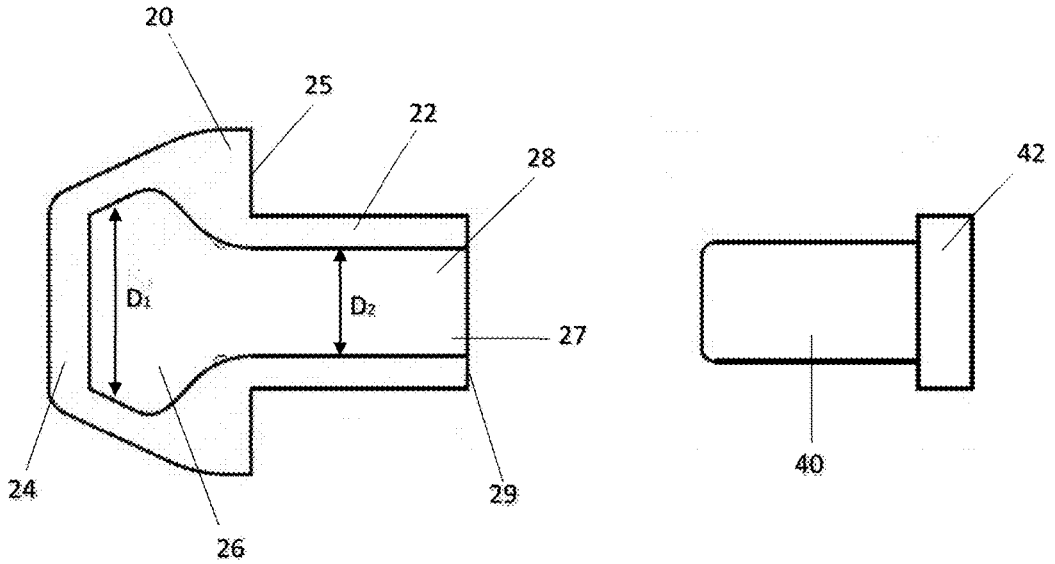
FIG. 5A shows a dart head and an insert for a toy dart according to a fifth embodiment of the present invention prior to connection.
Figure 5B:
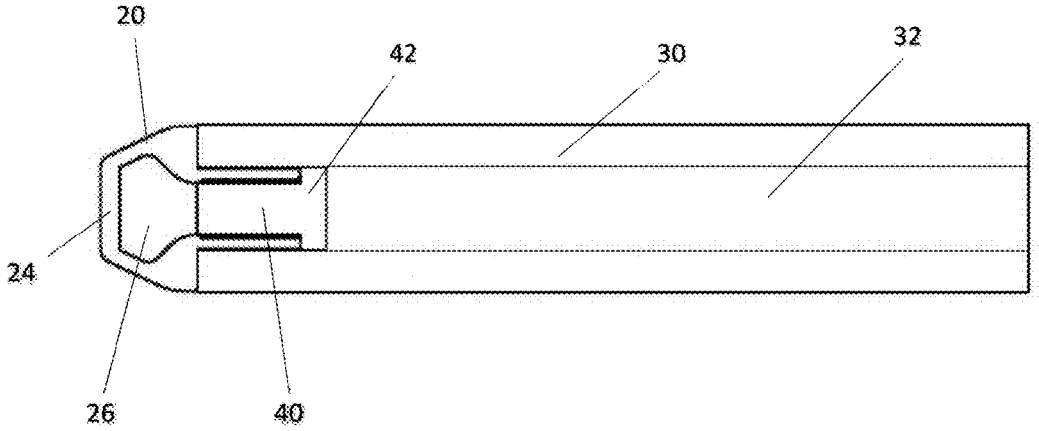
FIG. 5B shows the dart head, the insert of FIG. 5A and the dart body after connection to forma toy dart.

FIGS. 5A and 5B further show the arrangement of the hollow stem portion 22 as being substantially filled by the insert 40 along its length. The insert 40 can be solid or at least partially hollow, as shown in FIGS. 3A, 3B and 4A, 4B, respectively. Preferably, the insert 40 may comprise a weight member to provide additional weight to the dart 10 to thereby adjust or customize the flight performance of the dart. For example, a higher accuracy can be achieved by a relatively heavier dart due to its being less susceptible to the interfering air flow, but also a lower speed or acceleration of the dart due to its weight. However, a dart with lighter weight will be more susceptible to the surrounding air friction which not only results in lower shooting accuracy but also a shorter shooting distance. In one specific embodiment, it is found that a foam dart 10 with the dart body 30 having an external diameter of about 12 mm to about 13 mm, a length of the dart 10 of about 6 cm to 8 cm, and an overall weight of about 0.9 gram to 1.2 gram achieves a good balance between shooting distance, stability and thus shooting accuracy, although a person skilled in the art would appreciate that any variations and/or customizations to the configuration and/or dimension of the dart shall be encompassed, as long as they are considered suitable and applicable to the present invention without departing from the inventive concept.

In one embodiment, the insert 40 may provide additional support to the hollow stem portion 22 thereby assisting and/or improving engagement and/or adhesion between the outer wall surface of the stem portion 22 of the dart head 20 and the inner wall surface of the bore portion 32 of the dart body 30.

As more clearly shown in FIGS. 5A and 5B, the insert 40 may comprise a flange 42 at an end distal to the dart head 20. When the insert 40 is received into the cavity 28 of the stem portion 22, the flange 42 is adapted to abut the annular end wall 29 of the rear end opening 27 of the stem portion 22 to thereby position the insert 40 at or adjacent the open end 27, with the head portion 24 remaining hollow.

Figure 6:
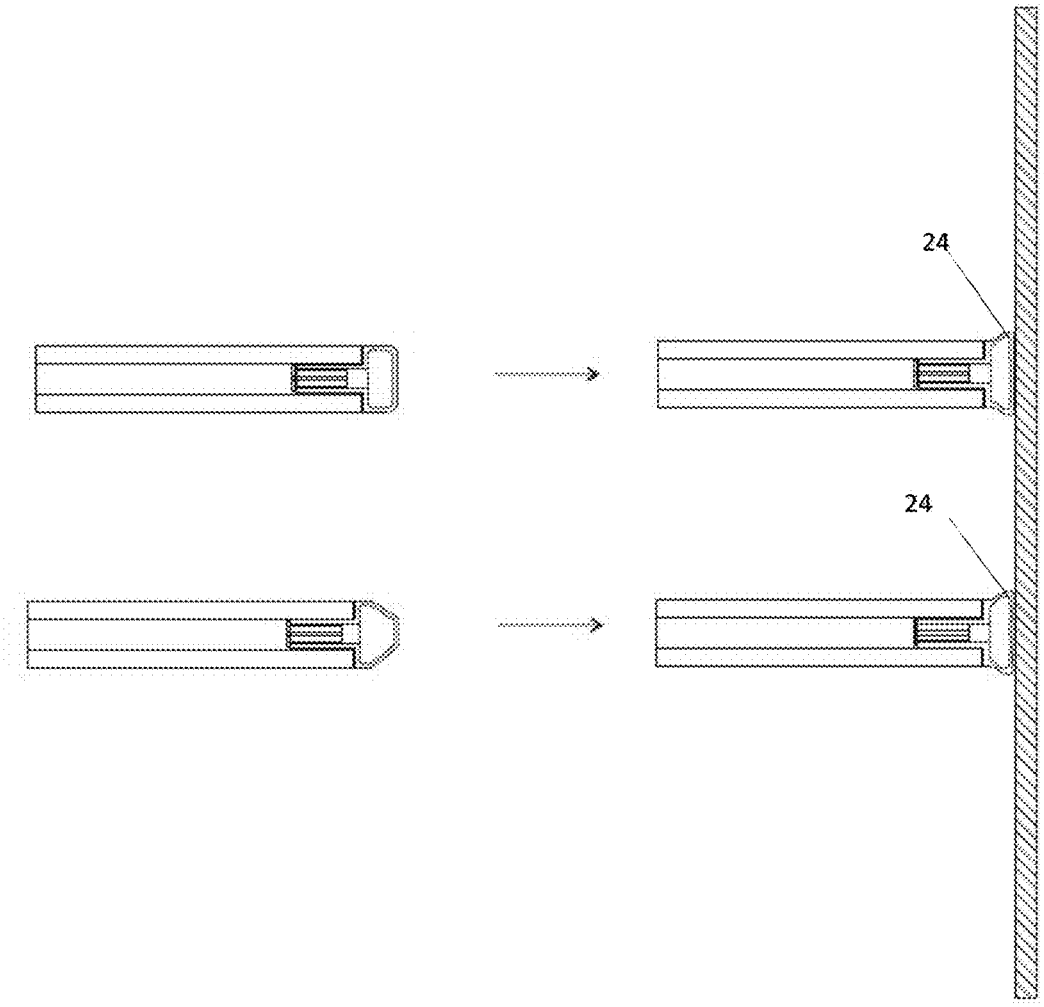
FIG. 6 shows the deformation of the embodied dart heads according to the present invention upon impact on a surface.

Particularly, the hollow head portion 24 is of sufficient resiliency such that, upon impact on a surface such as a target, the head portion 24 is adapted to resiliently deform, flatten or collapse to thereby increase the area of contact, i.e. the impact surface between the head portion 24 of the dart 10 and the target, as shown in the examples of FIG. 6. The increase in impact area due to the deformed or flattened head portion 24 is particularly advantageous in reducing the force of impact on the target struck by the dart, which significantly enhances the safety of the game. The deformation of the head portion 24 during an impact cushions the blow of the dart on the impact surface. The fluid communication between the head cavity 26 and the hollow stem portion 22 enhances the cushioning effect even in the case where the hollow stem portion has received a weighted insert 40. Where the weighted insert 40 also has a longitudinally extending bore, the diameter of this bore may be selected to exercise a degree of control on the rate of the cushioning effect by controlling the rate of fluid communication between the head cavity 26 and the hollow stem portion 22.

Preferably, the hollow head portion 24 may define at least one first transverse internal dimension ($D_1$) of the head cavity 26, and the hollow stem portion 22 defines at least one second transverse internal dimension ($D_2$) of the stem cavity 28, with the first transverse internal dimension ($D_1$) being larger than the second transverse internal dimension ($D_2$), as shown in FIG. 5A. This preferred configuration is found to facilitate the deformation of the head portion 24 for increasing the contact surface area with the target during an impact.

The volume of the head cavity 26 is preferably larger than the volume of the bore or cavity in the hollow stem portion 22.

Figure 7:
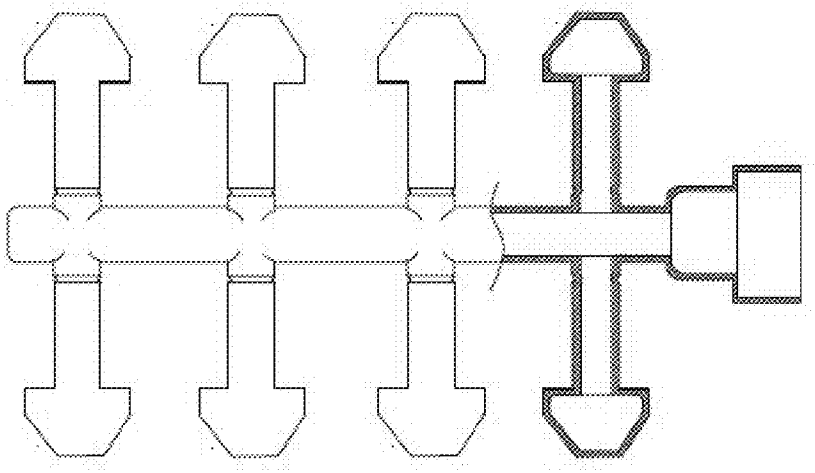
FIG. 7 shows a method of manufacturing a dart head according to an embodiment of the present invention.
Figure 8:
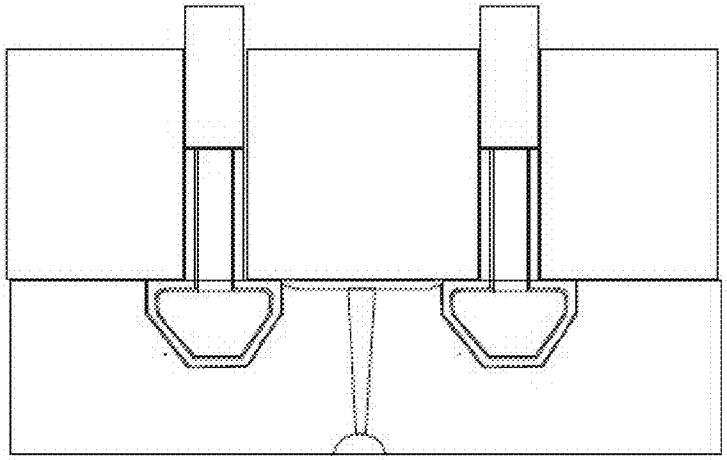
FIG. 8 shows another method of manufacturing a dart head according to an embodiment of the present invention.

The head portion 24 can be formed of one or more resilient polymeric materials such as, but not limited to, polyurethane foams, poly(ethylene-vinyl acetate), polyvinyl chloride, resins and/or a mixture thereof. In one embodiment, the integrally formed body 23 of the dart head 20 can be is formed by molding of the one or more of these resilient polymeric materials, for example, blow molding, injection molding, roto-casting (also known as rotational molding) or the like. Examples of blow molding and injection molding of the dart heads are shown in FIGS. 7 and 8, respectively.

Figure 9A:
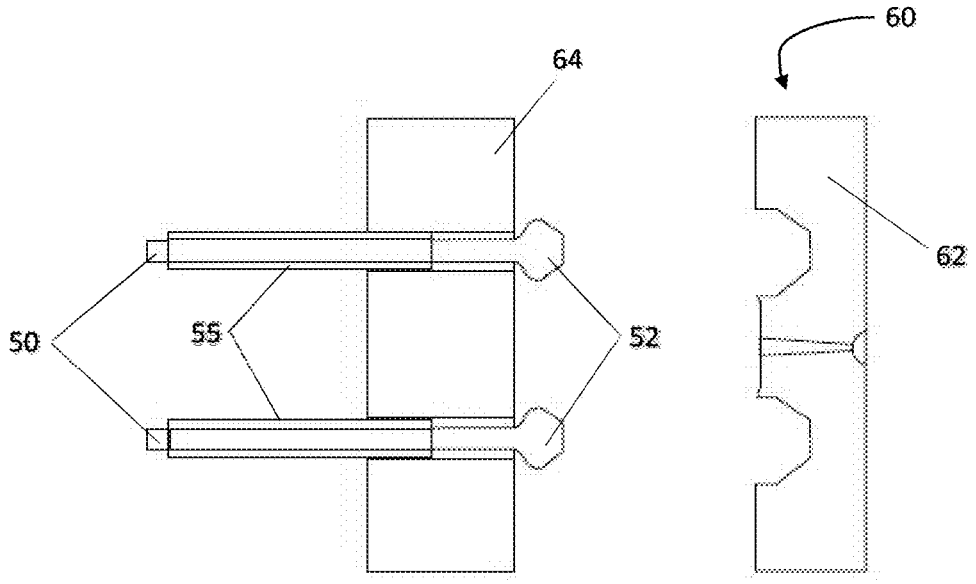
FIG. 9A to FIG. 9G show the method steps of manufacturing a dart head according to a further embodiment of the present invention.

FIGS. 9A to 9G illustrate an exemplified injection molding method for manufacturing the dart head of the present invention. Referring to FIG. 9A, shown is the step of providing a male mold 50 and a female mold 60 having at least a first female mold part 62 and a second female mold part 64. In this embodiment, the male mold 50 is movably connected at the second female mold part 64, and preferably, the male mold 50 is at least partially received at the second female mold part 64 and is slidably movable in a direction back and forth relative to the first female mold part 62.

The male mold 50 may comprise at least one male mold member 52. In this embodiment, the male mold member 52 preferably comprises an enlarged head connected with an elongated stem. The enlarged head is configured to conform substantially in shape with the first female mold part 62, and the elongated stem is configured to conform substantially in shape with the second female mold 64 part for molding the dart head.

Figure 9B:
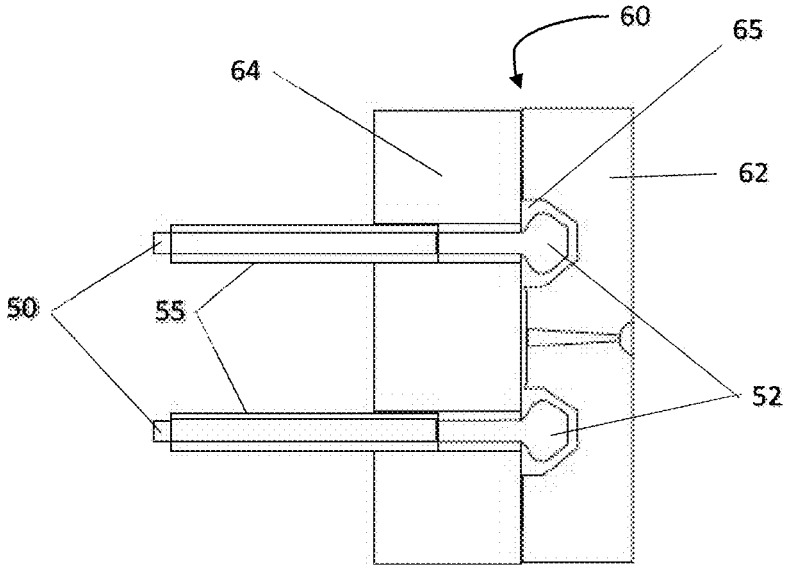
Figure 9C:
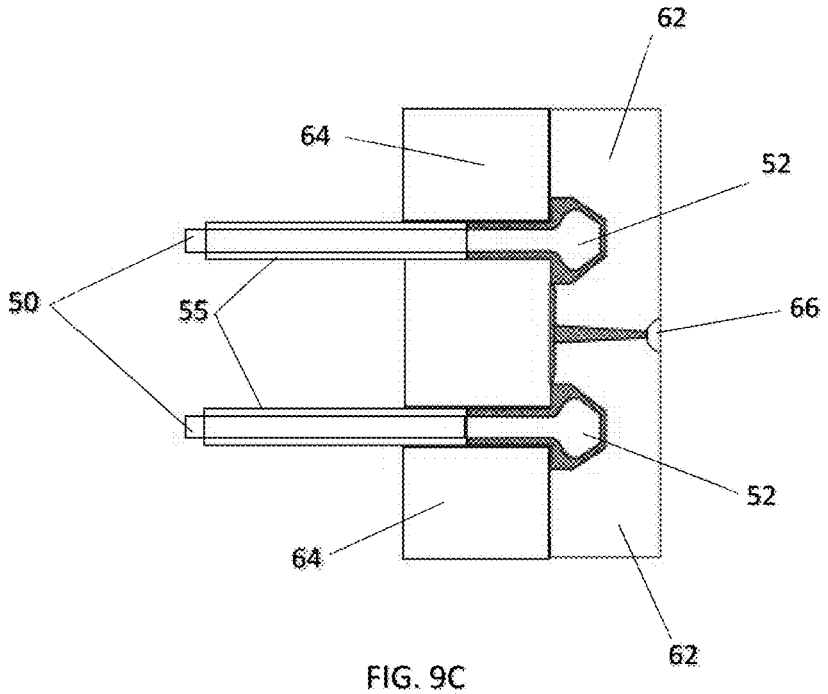

To begin the molding process, the first and the second female mold parts 62, 64 are brought to a close position which allows the male mold member 52 to be substantially encased within a molding cavity 65 defined by the first and the second female mold parts 62, 64, as shown in FIG. 9B. Subsequently, a flowable polymer is injected into the cavity 65 between the male and the female molds 50, 60 via an inlet 66, as shown in FIG. 9C. The polymer will flow over the male mold member 52 and eventually fill up the cavity 65 to integrally form the dart head 20 having the hollow enlarged head portion 24 and the hollow stem portion 22 having an undercut opening 27 at the end of the stem portion 22.

The flowable polymer can be one or more of the resilient polymeric materials as described above, such as, but not limited to, polyurethane foams, poly(ethylene-vinyl acetate), polyvinyl chloride, resins and/or a mixture thereof in their melted or solution form. A person skilled in the art would appreciate that the present invention should not be limited to the described examples of the flowable or resilient polymeric materials, but any other flowable or resilient materials which is considered applicable and suitable for the present application, should also be encompassed.

Figure 9D:
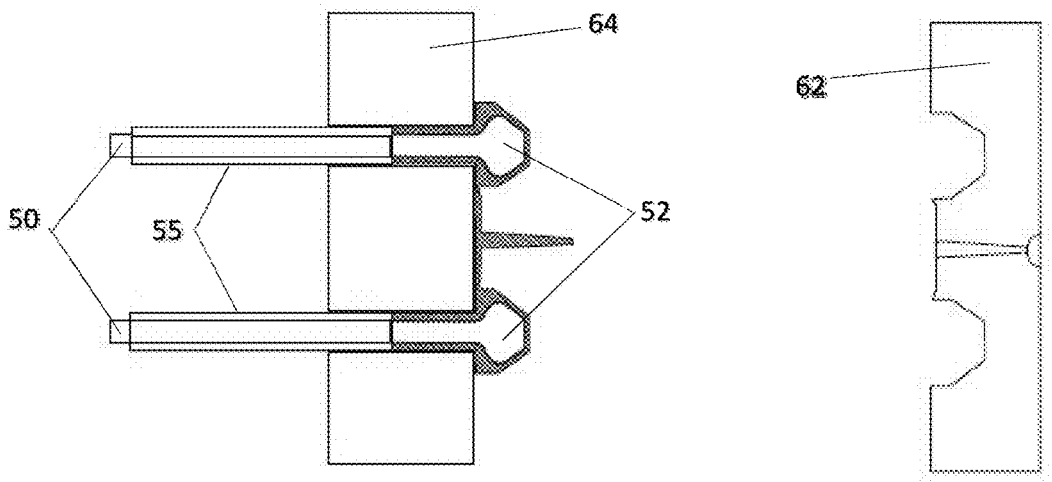
Figure 9E:
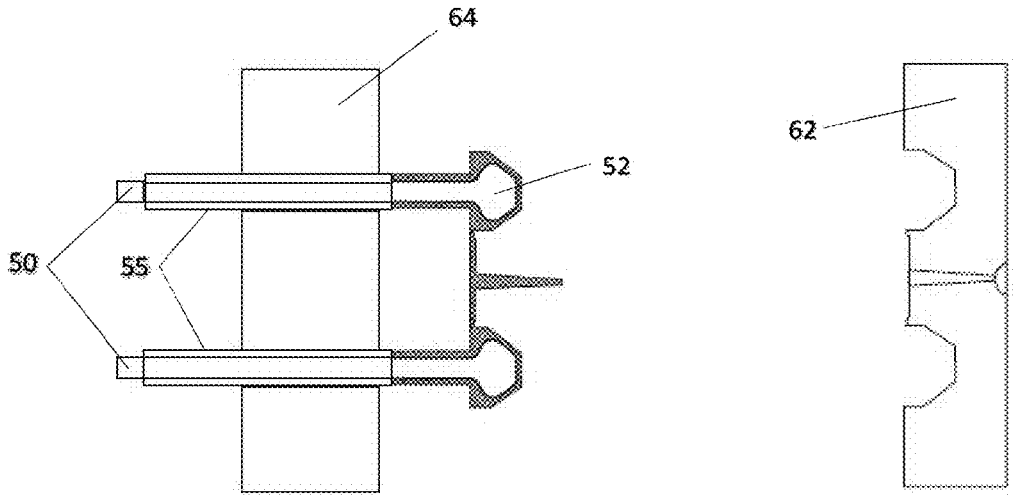
Figure 9F:
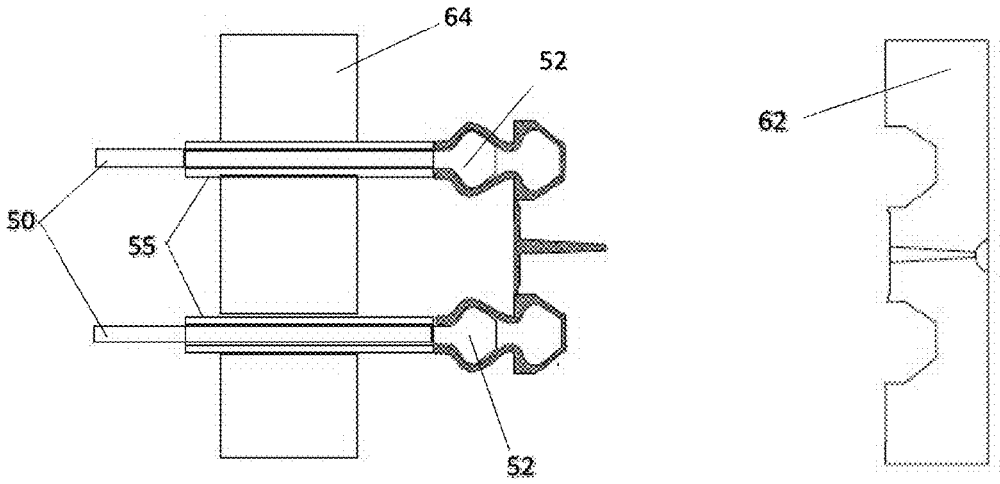
Figure 9G:
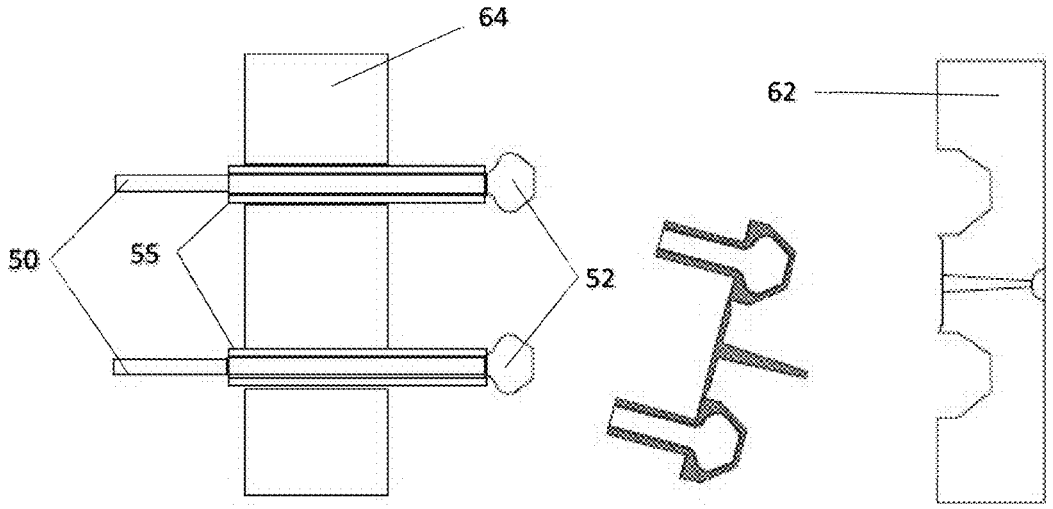

After the polymer is solidified between molds 50, 60, the second female mold part 64 and the male mold 50 will be moved away from the first female mold part 62. As the solidified, molded polymer is retained at the male mold member 52 of the male mold 50, the movement of the second female mold part 64 away from the first female mold part 62 will thus separate the molded polymer from the first female mold part 62, as shown in FIG. 9D. Alternatively, this step may also be performed by moving the first female mold part 62 away from the male mold 50 and the second female mold part 64. The molded polymer can then be mechanically released or discharged from the second female mold part 64 and the male mold member 52 of the male mold 50.

Preferably, the mechanically releasing step can be conducted in a two-steps process. First, with the second female mold part 64 remains stationary, the male mold 50, which has been movably engaged at the second female mold part 64, can be arranged to slide forward and away from the second female mold part 64 to disengage the molded polymer from the second female mold part 64. Alternatively, the male mold 50 may remain stationary but with the second female mold part 64 moving backward and away from the male mold member 52 to thereby disengage the molded polymer from the second female mold part 64, see FIG. 9E.

The male mold 50 preferably comprises a pushing means 55 adapted to mechanically push the molded polymer off of the mold member 52 of the male mold 50. In one embodiment, the pushing means 55 is sleevably arranged at an end of the elongated stem of the male mold member 52, with its leading end abutting the open end 27 of the molded, polymer dart head. In the second step, the pushing means 55 will be arranged to move towards the molded polymer to thereby mechanically push it off of the male mold member 52 over the open end 27, see FIGS. 9F and 9G. It is important that the molded polymer is of sufficient resiliency such that the molded dart head 20, especially the narrow stem portion 22 and the undercut opening 27, is resilient enough to deform to thereby slide or pass over the enlarged head of the male mold member 52 (see FIG. 9F), such that it can be released from the male mold 50 upon the mechanical pushing by the pushing member 55 without breaking apart. The molded polymer should also be resilient enough to restore its original molded shape after the release (see FIG. 9G). It is also found that a male mold member 52 having an enlarged head with rounded corners will facilitate the mechanical releasing process.

FIGS. 10A to 10G illustrates a similar process to that of FIGS. 9A to 9G, with the two-steps of mechanically releasing the molded polymer being assisted by an electric solenoid, by way of example, although a person skilled in the art would understand that the mechanical pushing or releasing can also be achieved by some other known means, such as, but not limited to, pneumatic, hydraulic and/or motor systems as well as other mechanical linkages.

Figure 10A:
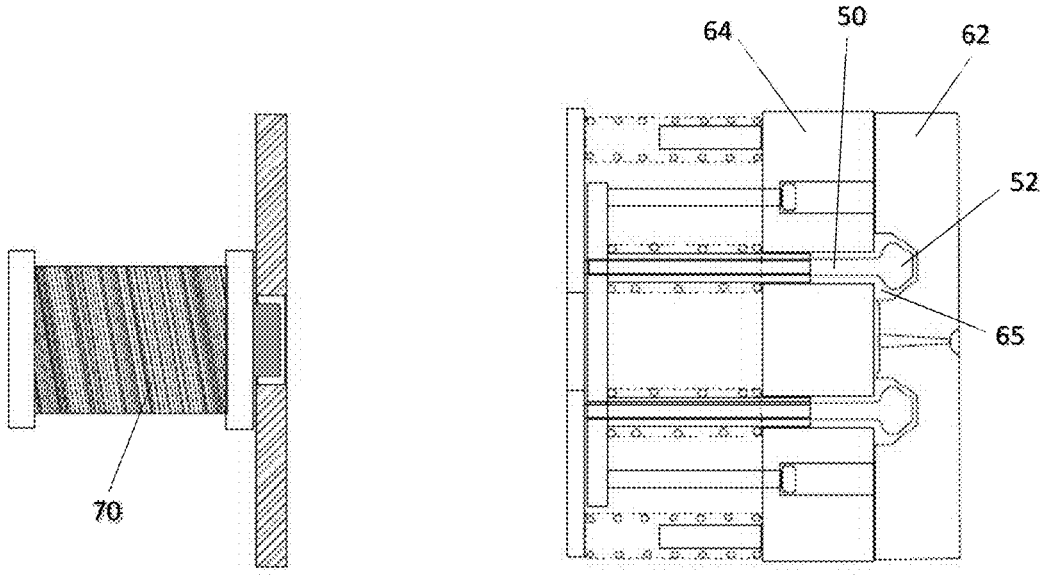
FIG. 10A to FIG. 10G show the method steps of manufacturing a dart head according to a further embodiment of the present invention.
Figure 10B:
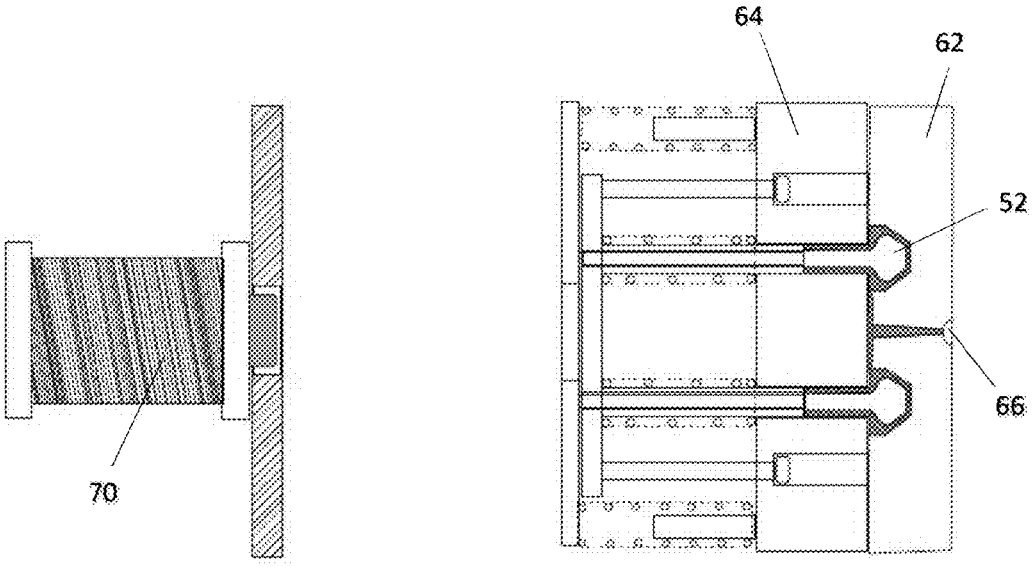

Referring to FIG. 10A, shown is the step for the first and the second female mold parts 62, 64 as being brought together to a closely adjacent position to substantially encase the male mold member 52 in the molding cavity 65. A flowable polymer will then be injected into the cavity 65 via an inlet 66, as shown in FIG. 10B. After solidification, a molded polymer dart head integrally formed with an enlarged head portion 24 and a stem portion 22 with an undercut opening 27 at its end will be formed.

Figure 10C:
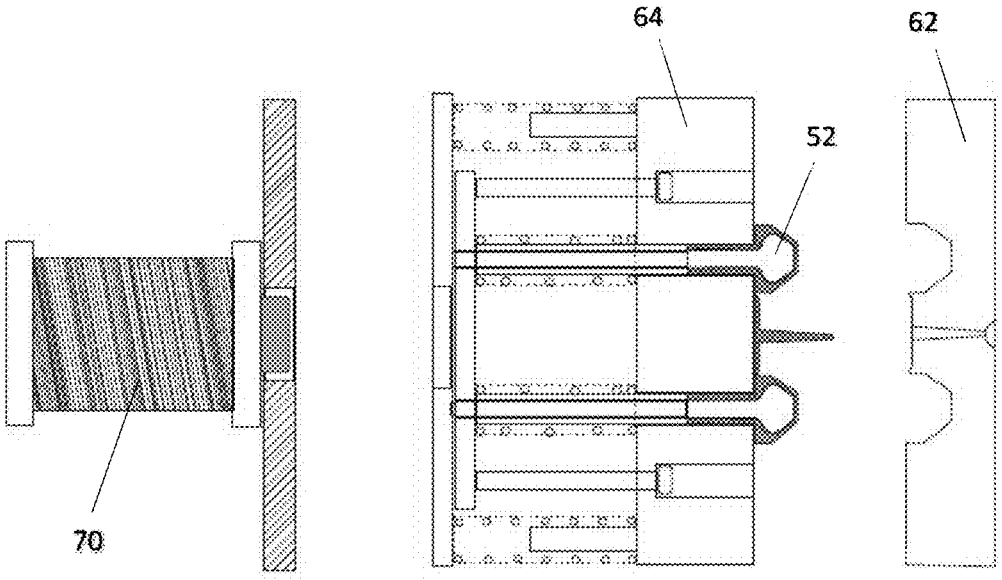

The second female mold part 64 and the male mold 50 will then be arranged to move away from the first female mold part 62, with the solidified, molded polymer being retained at the male mold member 52 of the male mold 50, as shown in FIG. 10C.

Figure 10D:
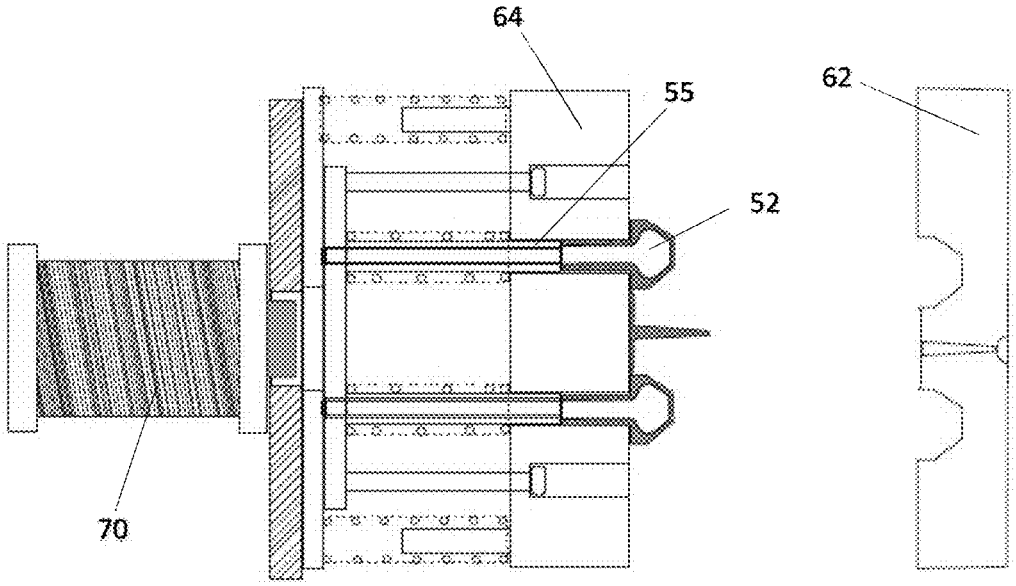
Figure 10E:
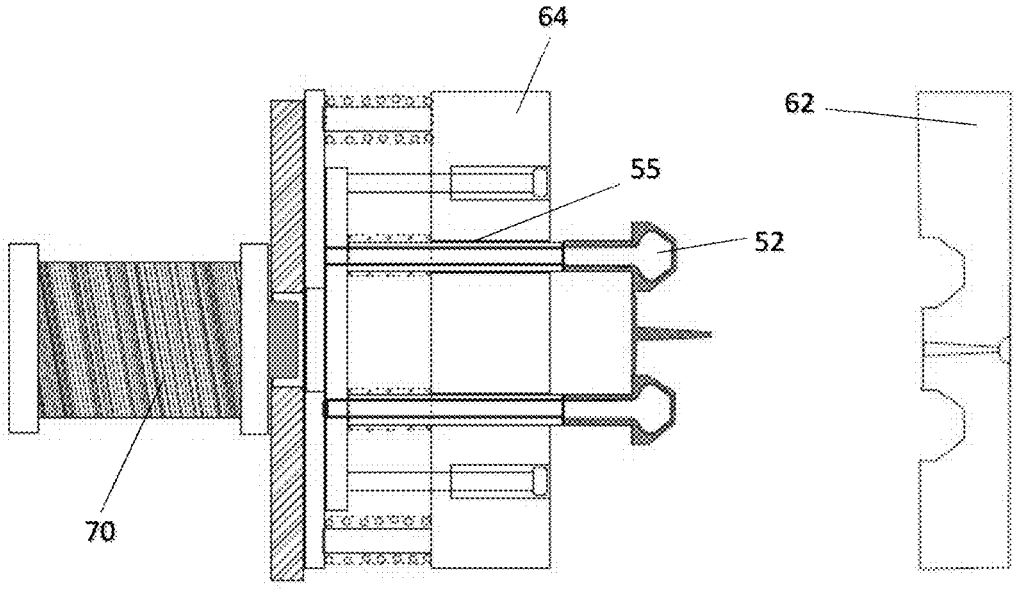
Figure 10F:
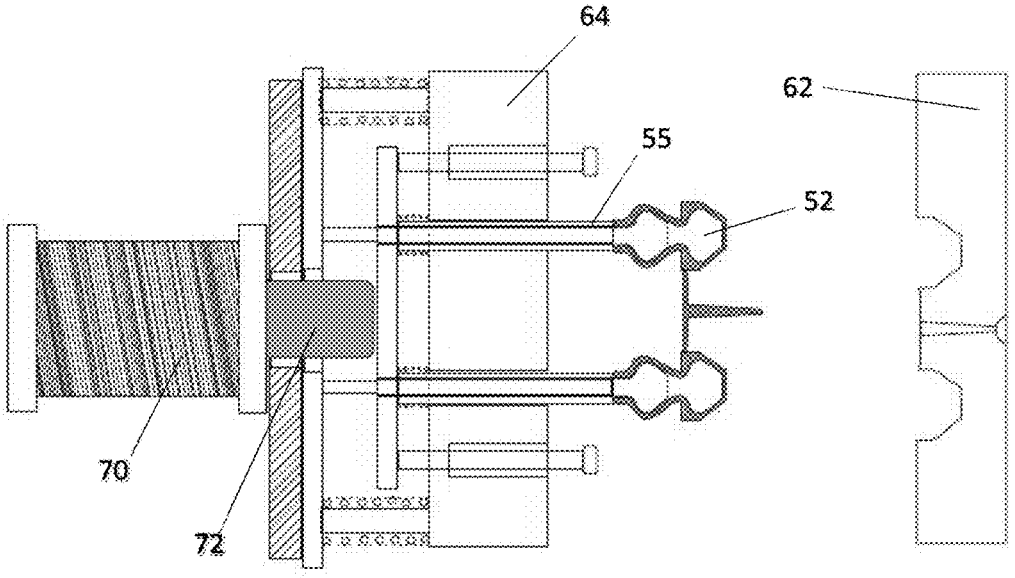
Figure 10G:
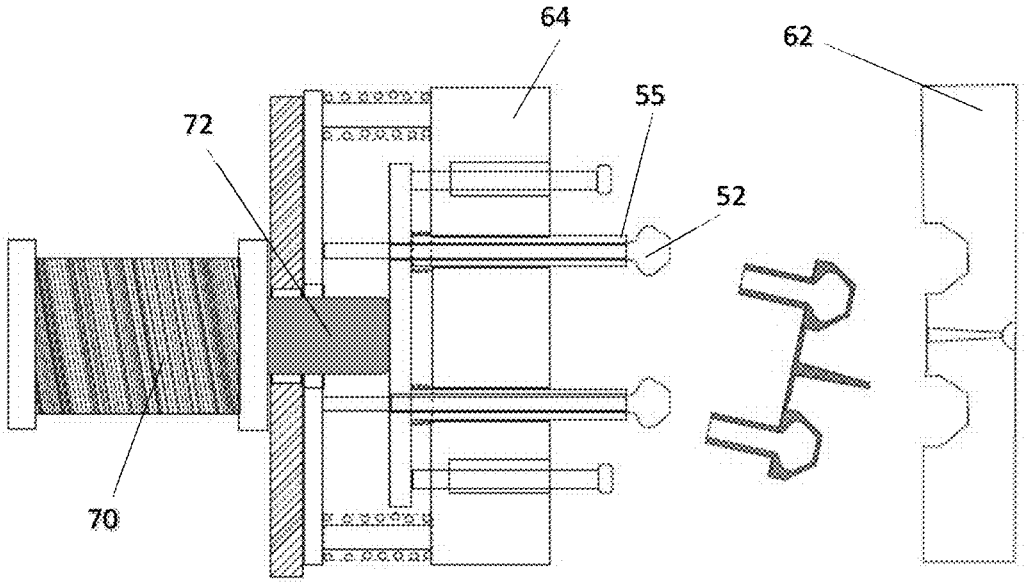

To begin the two-steps of the mechanically releasing process, the second female mold part 64 will first be arranged to engage with the electric solenoid 70 via one or more mechanical linkages, as shown in FIG. 10D. In this embodiment, the second female mold part 64 is adapted to slide backward, i.e. towards the solenoid 70 and away from the mold member 52 to thereby disengage the molded polymer from the second female mold part 64, see FIG. 10E. In the next step, the electric solenoid 70 will be actuated to impose a strong mechanical push via a pusher 72 towards the pushing means 55 to thereby mechanically push the molded polymer off of the mold member 52 of the male mold 50 via the undercut opening 27 of the molded dart head 20, as seen in FIGS. 10F and 10G. Again, it is essential for the molded polymer to be of sufficient resiliency such that the dart head 20 is resilient enough for the narrow step portion 24 and the undercut opening 27 to be deformable to thereby slide or pass over the enlarged head of the male mold member 52 (see FIG. 10F). The resiliency of the molded polymer also allows the released dart head 20 to quickly or instantly restore its original molded shape, without any tearing, ripping or fractures to the structure (see FIG. 10G).

The present invention is advantageous in that it provides a hollow and resilient dart head for use in a foam dart. The dart head is of sufficient resiliency such that, upon impact on a surface such as a target, the hollow head portion of the dart head is adapted to resiliently deform, flatten or collapse to thereby increase the area of contact, i.e. the impact surface with the target. As a result, the force of impact imposed on the struck target can be significantly reduced to lower the risk of injuries and thus to enhance safety of the game. The hollow stem portion of the dart head also allows adjustment of the dart weight by receiving a weight carrying insert, which facilitates customization of flight performance of the resulting toy dart as well as possible control of the rate of deformation of the hollow head portion during an impact on a target. The present invention also provides a relatively quick and easy manufacturing process to integrally mold the hollow dart head, with the molded material being resilient enough to allow the integrally formed dart head to be easily released from the molding equipment in a simple two steps, mechanically pushing and/or pulling process.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims hereof, any element expressed as a means for performing a specified function is intended to encompass any way of performing that function. The invention as defined by such claims resides in the fact that the functionalities provided by the various recited means are combined and brought together in the manner which the claims call for. It is thus regarded that any means that can provide those functionalities are equivalent to those shown herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such prior art does not constitute an admission that the prior art forms a part of the common general knowledge in the art.

The invention claimed is:

1. A method of manufacturing a dart head for a toy dart, the dart head comprising a body having an enlarged, hollow head portion integrally formed in a single, continuous piece with a stem portion longitudinally extended from the head portion, the method comprising the steps of:

providing a male mold and a female mold having at least a first female mold part and a second female mold part, the male mold and the female mold cooperatively define a molding cavity therebetween;

injecting a flowable polymer into the molding cavity between the male mold and the female mold;

solidifying the polymer between the male mold and the female mold to form a solidified, molded polymer;

separating the first female mold part from the molded polymer; and mechanically releasing the molded polymer from the second female mold part and the male mold;

wherein the molded polymer is of sufficient resiliency such that it is deformable to thereby overcome the male mold upon the mechanically releasing step without breaking apart; and is restorable to its original shape after the mechanically releasing step.

2. The method of manufacturing the dart head according to claim 1, wherein the step of mechanically releasing the molded polymer from the second female mold part and the male mold comprises first disengaging the molded polymer from the second female mold part, and subsequently, releasing the molded polymer from the male mold.

3. The method of manufacturing the dart head according to claim 2, wherein the male mold is movably connected at the second female mold part, and is adapted to move away from the second female mold part thereby disengaging the molded polymer from the second female mold part.

4. The method of manufacturing the dart head according to claim 1, wherein the male mold comprises a pushing means adapted to mechanically push the molded polymer off from the male mold.

5. The method of manufacturing the dart head according to claim 1, wherein the male mold comprises at least one male mold member having an enlarged head connected with an elongated stem, with the enlarged head being substantially conform in shape with the first female mold part, and the elongated stem being substantially conform in shape with the second female mold part for molding the dart head.

* * * * *